US005377963A

United States Patent [19]

Lehman

[11] Patent Number: 5,377,963

[45] Date of Patent: Jan. 3, 1995

[54] MACHINE VISE

[76] Inventor: Lynn D. Lehman, 6876 Blough Ave., SW., Navarre, Ohio 44662

[21] Appl. No.: 164,818

[22] Filed: Dec. 10, 1993

[51] Int. Cl.[6] ..... B25B 1/10

[52] U.S. Cl. ..... 269/156; 269/210; 269/242

[58] Field of Search ..... 269/155, 309, 167, 171, 269/171.5, 156, 902, 904, 45, 64, 210, 242

[56] References Cited

U.S. PATENT DOCUMENTS

| | | | |
|---|---|---|---|
| 381,890 | 4/1888 | Taylor . | |
| 426,341 | 4/1890 | Strong | 269/64 |
| 934,589 | 9/1909 | Bradford | 269/171 |
| 1,131,869 | 3/1915 | Schade | 269/309 |
| 1,336,754 | 4/1920 | Parmelee . | |
| 2,817,892 | 12/1957 | Jones | 269/45 |
| 3,017,174 | 1/1962 | Reuter | 269/904 |
| 3,166,307 | 1/1965 | Sego . | |
| 3,345,061 | 10/1967 | Schaefer | 269/902 |
| 3,394,389 | 7/1968 | Amir . | |
| 3,982,740 | 9/1976 | Gutman | 269/155 |
| 4,184,667 | 1/1980 | Alessio . | |
| 4,232,857 | 11/1980 | Bezubik et al. . | |
| 4,957,257 | 9/1990 | Gonzalez | 269/167 |
| 4,962,918 | 10/1990 | Yang | 269/156 |
| 5,172,896 | 12/1992 | Beere | 269/902 |

FOREIGN PATENT DOCUMENTS

| | | | |
|---|---|---|---|
| 827923 | 7/1949 | Germany | 269/153 |

*Primary Examiner*—Robert C. Watson
*Attorney, Agent, or Firm*—Michael Sand Co.

[57] ABSTRACT

A machine vise for securing a workpiece adjacent a cutting tool has a body with a variety of clamping recesses milled therein. The body of said vise has an aperture therethrough for slidably accepting a jaw bar. The jaw bar includes a moveable jaw and a guide channel which is slidably mounted within the aperture for positioning the movable jaw adjacent a stationary jaw for gripping a workpiece therebetween. A movable stop block sets the height of the workpiece and includes ratchet teeth for engaging a rack milled into the body. A fastener tightens the stop block in a selected position on the rack. Bolts having oppositely extended sections adjacent the moveable jaw with respect to the stationary jaw. The height of the workpiece is accurately set by the stop block.

17 Claims, 5 Drawing Sheets

MACHINE VISE

BACKGROUND OF THE INVENTION

1. Technical Field

The invention relates generally to an improved machine vise. More particularly, the invention relates to a machine vise for securing a workpiece adjacent a cutting tool. Specifically, the invention relates to apparatus for positioning an elongated bar-shaped workpiece adjacent a cutting tool such that the workpiece is secured in the vise and rests on an adjustable base to accurately set the length of the workpiece.

2. Background Information

A variety of industries require the fabrication of close tolerance elongated bar-shaped workpieces. Mold-making is one such industry. Specifically, ejector pins and core pins are an integral part of the mold, the manufacture of which requires the mold maker to adhere to close tolerances.

Ejector pins are utilized to remove a recently formed part from the mold. These pins must be held to very close tolerances both in diameter and in overall length. If the pin diameter is even slightly smaller than tolerance, the molded material may be forced between the pin and the mold body decreasing the overall appearance of the part or possibly jamming the mold and reducing cycle time. Alternatively, if the pin diameter is slightly larger than tolerance, the pin will not fit within the pin hole milled into the mold body. If the length of the pin is not held to tolerance, the finished part will not have a smooth surface finish. Moreover, if the pin is to long, when the mold is closed, the pin may cause decreased wall thickness, or may even damage the mold itself.

Similarly, core pins must be milled to close tolerances. Core pins are utilized to form or punch holes in the molded product. The diameter and length of these pins must be held within close tolerances for many of the same reasons discussed above with regard to ejector pins.

Whether ejector pins or core pins are being fabricated, it is common for a single mold to require multiple identical pins, or multiple molds to be fabricated simultaneously. The need has arisen for a vise which would allow the pin length to be accurately set for the first pin, with multiple pins being cut to length from this original setup thereby significantly reducing fabrication time and cost.

Further, pins are often nested or cut with various keyways for ease of manufacturing, installation or operation. These keyways and holes must also be manufactured to close tolerances.

While prior art devices are presumably sufficient to achieve the purposes for which they are intended, they present a number of drawbacks. Specifically, known devices do not provide for a means to accurately position an elongated bar-shaped workpiece adjacent a cutting tool such that the workpiece may be both end milled and milled along its longitudinal axis. Further, known vises do not provide a stop block which may be used to set the workpiece length, and which may remain set while subsequent workpieces are milled to length. Further, known machine vises are time consuming to adjust.

Therefore, the need has arisen for a machine vise which will retain a workpiece adjacent a cutting tool, such that the workpiece may be cut to close tolerances whether the part is being end milled, or milled along its longitudinal axis. The need has also arisen for a machine vise wherein multiple pins may be cut to length without resetting the stop block on the vise. Lastly the need exists for a vise which may be quickly adjusted to accept workpieces of varying diameter and length.

SUMMARY OF THE INVENTION

Objectives of the invention include providing an improved machine vise of the type for securing an elongated workpiece having a generally bar-shaped configuration adjacent a cutting tool.

A further objective includes providing such a vise which may be quickly adjusted to secure workpieces having a variety of cross-sections and lengths.

Another objective is to provide such a vise which includes a stop block for setting the length of a workpiece when the workpiece is milled to length.

Yet another objective is to provide such a machine vise with a stop block which remains in fixed position as multiple workpieces are milled to length to allow the fabrication of multiple workpieces having similar lengths, which length is held to very close tolerances.

A still further objective is to provide such a machine vise where the stop block may be quickly and incrementally adjusted.

Yet another object of the invention to provide a vise wherein highly stressed and wear parts are easily removed for replacement.

A still further objective is to provide such a machine vise which is of simple construction, which achieves the stated objectives in a simple, effective and inexpensive manner, and which solves problems and satisfies needs existing in the art.

These and other objectives and advantages of the invention are obtained by the improved machine vise for securing a workpiece adjacent a cutting tool the general nature of which may be stated as including a body having an aperture; a stationary jaw formed on said body; a moveable jaw bar slidably received within said aperture; adjustment means for moving the jaw bar within said aperture between clamped and unclamped positions; block means for supporting an end of a workpiece in a selected position; and positioning means for positioning the block means in said selected position.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
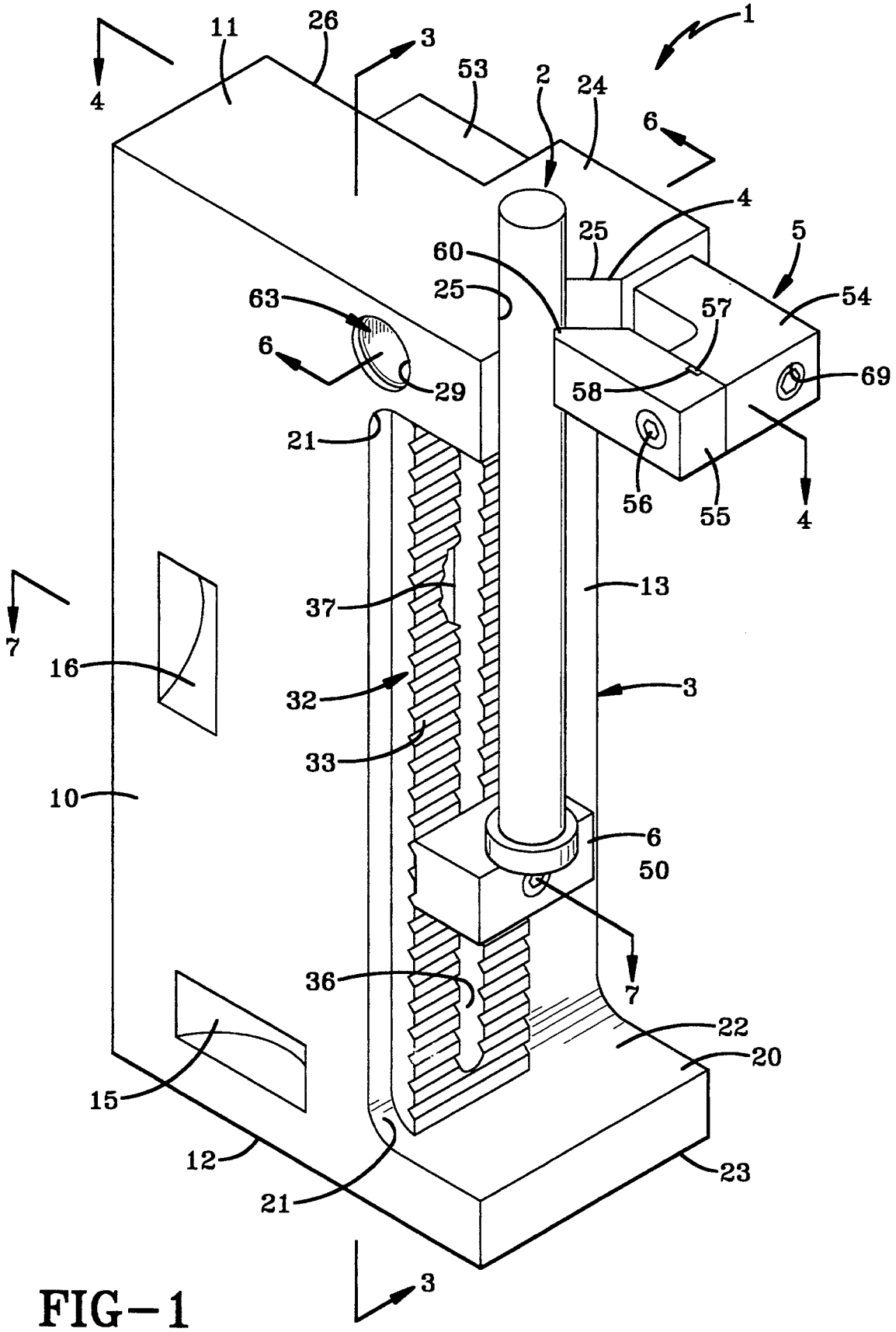
FIG. 1 is a front perspective view of the machine vise with a portion broken away shown in combination with an elongated bar-shaped workpiece.

The improved machine vise of the present invention is indicated generally at 1, and is adapted to secure a workpiece which is illustrated in FIG. 1 and indicated generally at 2. Machine vise 1 may be manufactured from a variety of materials, but solid steel is utilized in the preferred embodiment. Workpiece 2 may be of any size or shape, but preferably it is elongated. Moreover, while any cross-sectional configuration may be clamped in the vise of the present invention, a round bar-shaped workpiece is shown in combination with the preferred embodiment, with the understanding that the present invention is not limited to use with workpieces having this configuration.

Figure 2:
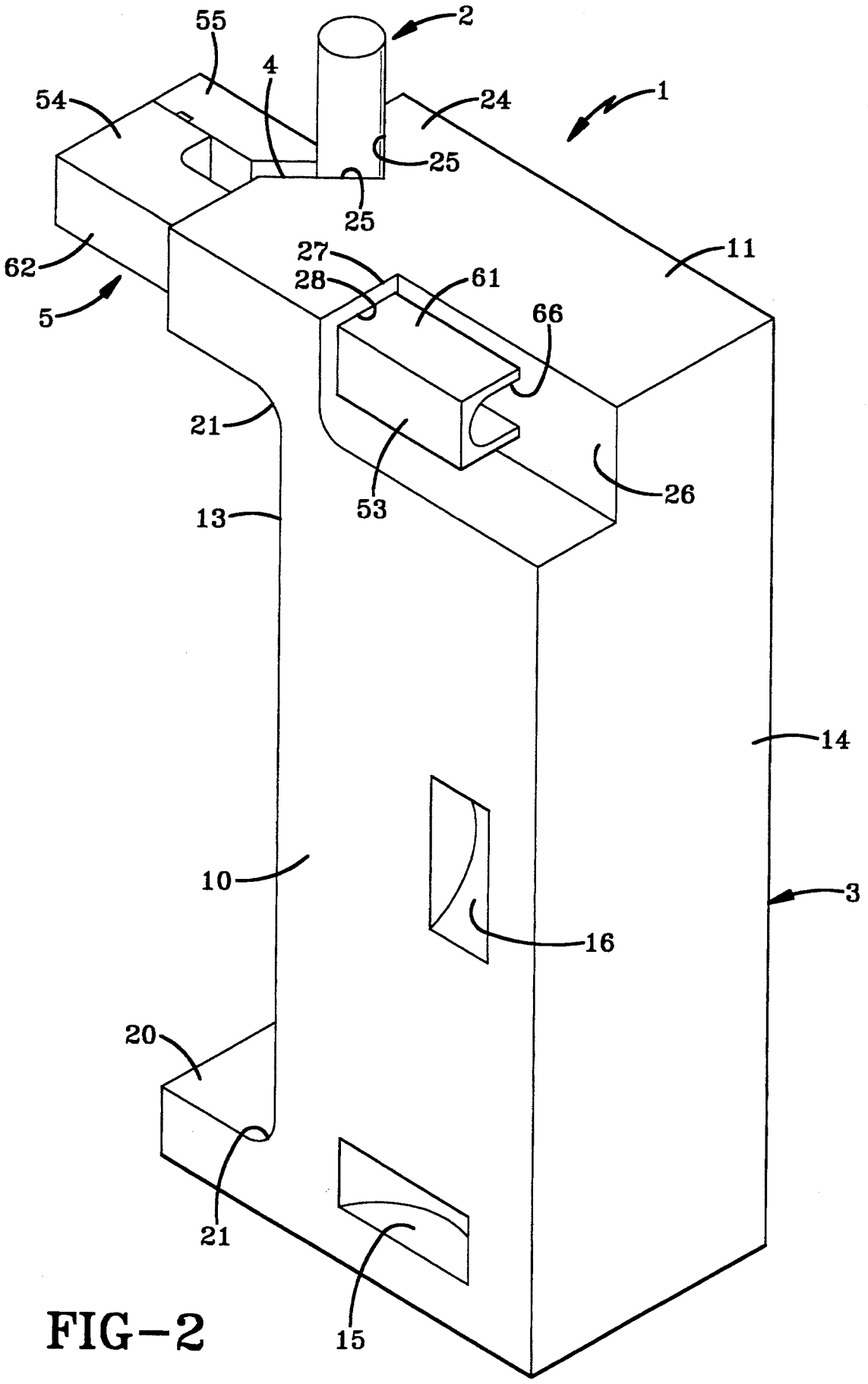
FIG. 2 is a rear perspective view of the machine vise shown in combination with an elongated bar-shaped workpiece.

Referring specifically to FIGS. 1 and 2, vise 1 includes a body 3, a stationary jaw 4 integrally formed with body 3, a moveable jaw bar indicated generally at 5, and a stop block 6. Body 3 includes a pair of parallel spaced apart side surfaces 10, a top and a bottom surface 11 and 12 respectively, which are normal to side surfaces 10, and a front and a rear surface, 13 and 14 respectively.

Each surface 10 includes a first clamping recess 15 and a second clamping recess 16, each adapted to receive a jaw of a clamp (not shown) to secure vise 1 adjacent a cutting tool. Clamping recess 15 accepts a clamp jaw when vise 1 is used in the position shown in FIG. 1 standing on end surface 12. Clamping recess 16 accepts a clamp jaw when vise 1 is lying on rear surface 14; if for example, workpiece 2 is to be cut along its longitudinal axis.

A lower flange 20 extends outwardly from front surface 13, and joins surface 13 at a fillet 21. Flange 20 includes an upper surface 22 and a lower surface 23 which is coplanar with end surface 12. Flange 20 adds stability to vise 1 when being utilized in the position shown in FIG. 1, and also provides a lower rigid stop block.

An upper flange 24 extends outwardly from front surface 13 and also joins front surface 13 at a fillet 21. Flange 24 extends outwardly from body 3 substantially the same distance as flange 20. A V-shaped groove 25 is cut into flange 24 forming stationary jaw 4. As should be apparent to one of ordinary skill in the art, while stationary jaw 4 is shown to be V-shaped, it could have a variety of configurations known in the art without departing from the spirit of the present invention, with the V-shape being beneficial for securing a cylindrical workpiece adjacent a cutting tool.

Figure 4:
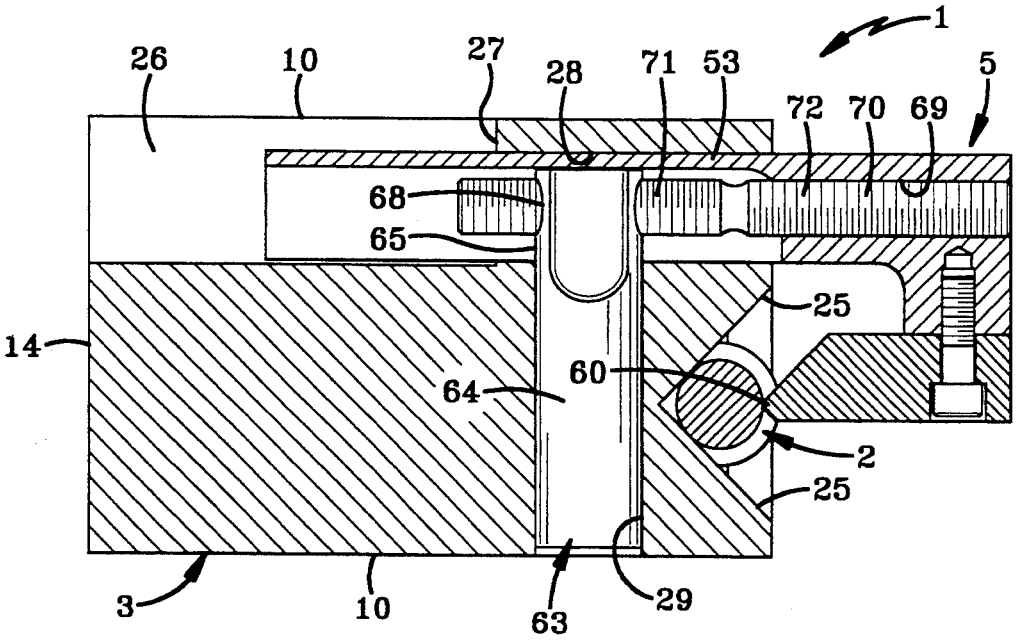
FIG. 4 is an end sectional view taken substantially along line 4—4 of FIG. 1.
Figure 6:
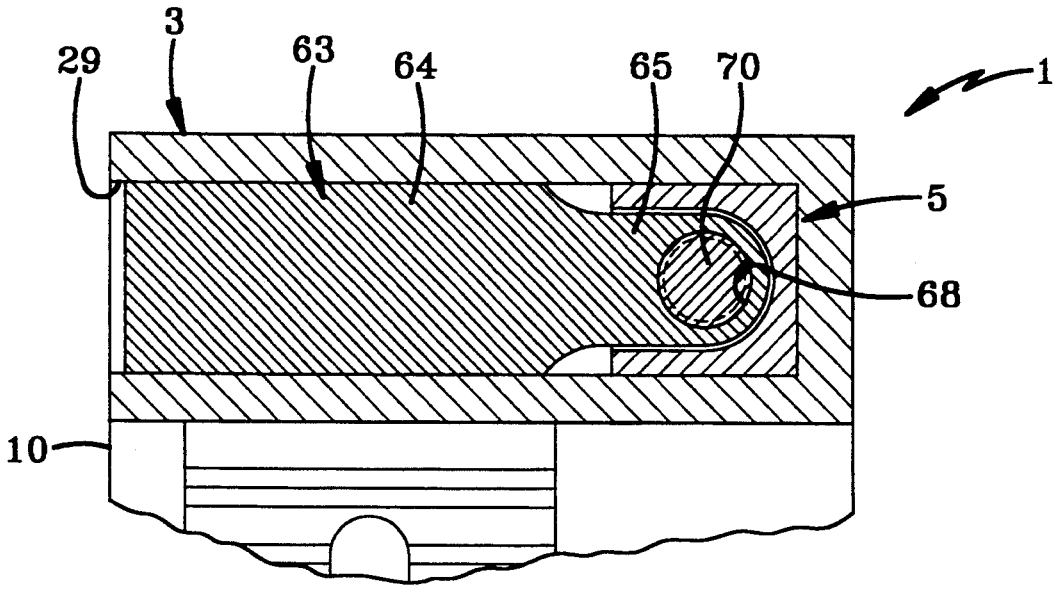
FIG. 6 is a fragmentary sectional view taken along line 6—6 of FIG. 1.
Figure 7:
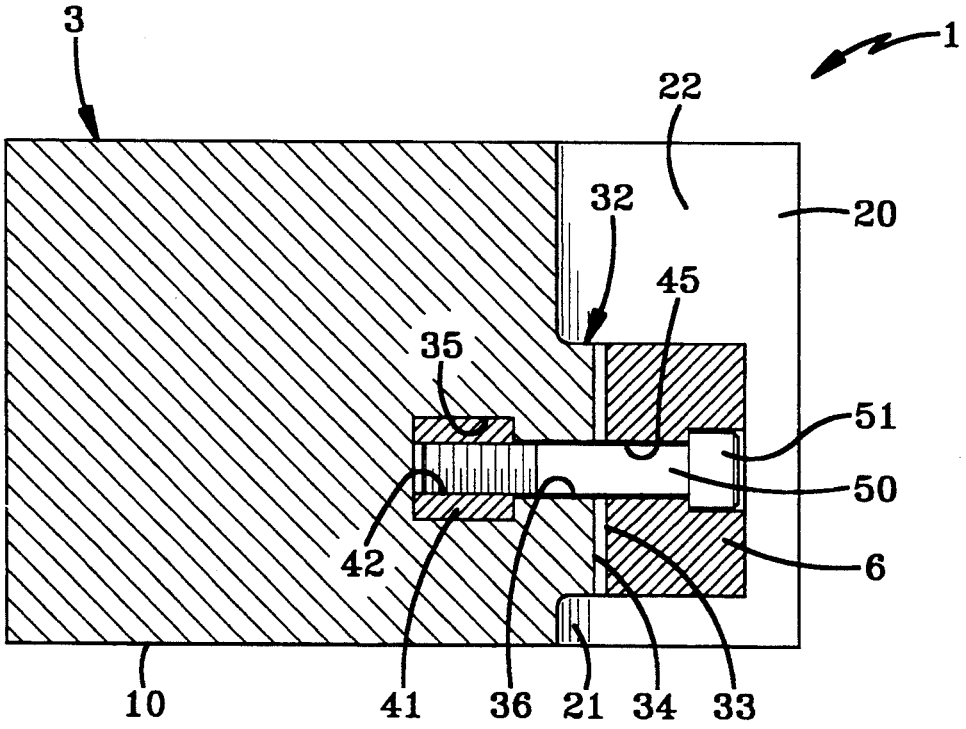
FIG. 7 is a sectional view taken along line 7—7 of FIG. 1.

Referring specifically to FIGS. 1, 2 and 4, a substantially rectangular recess 26 is milled into body 3 at a juncture of rear surface 14, top surface 11 and side surface 10, which recess forms a recessed wall 27. Recessed wall 27 includes a square hole 28 which extends through body 3 and upper flange 24. An aperture 29 extends through side surface 10 at an angle substantially orthogonal to hole 28, and joins hole 28 as best seen in FIGS. 1, 4 and 6 for purposes described below.

In accordance with one of the main features of the invention, a rack 32 extends along front surface 13 between flanges 20 and 24. Rack 32 is formed of a plurality of equally placed rack teeth 33 (FIG. 3) providing equally spaced recesses 34 interposed therebetween. A run or slide 35 is formed in body 3 and extends generally throughout the length of rack 32 and parallel therewith. Run 35 opens to bottom surface 12 at an open end 40. A slot 36 is formed in racks 32 and extends through the center thereof and communicates with run 35 along its longitudinal axis. Run 35 is wider than slot 36 in the transverse direction thereby forming a pair of spaced shoulders 37, one lying on either side of slot 36 and extending along the slot's entire length.

Figure 3:
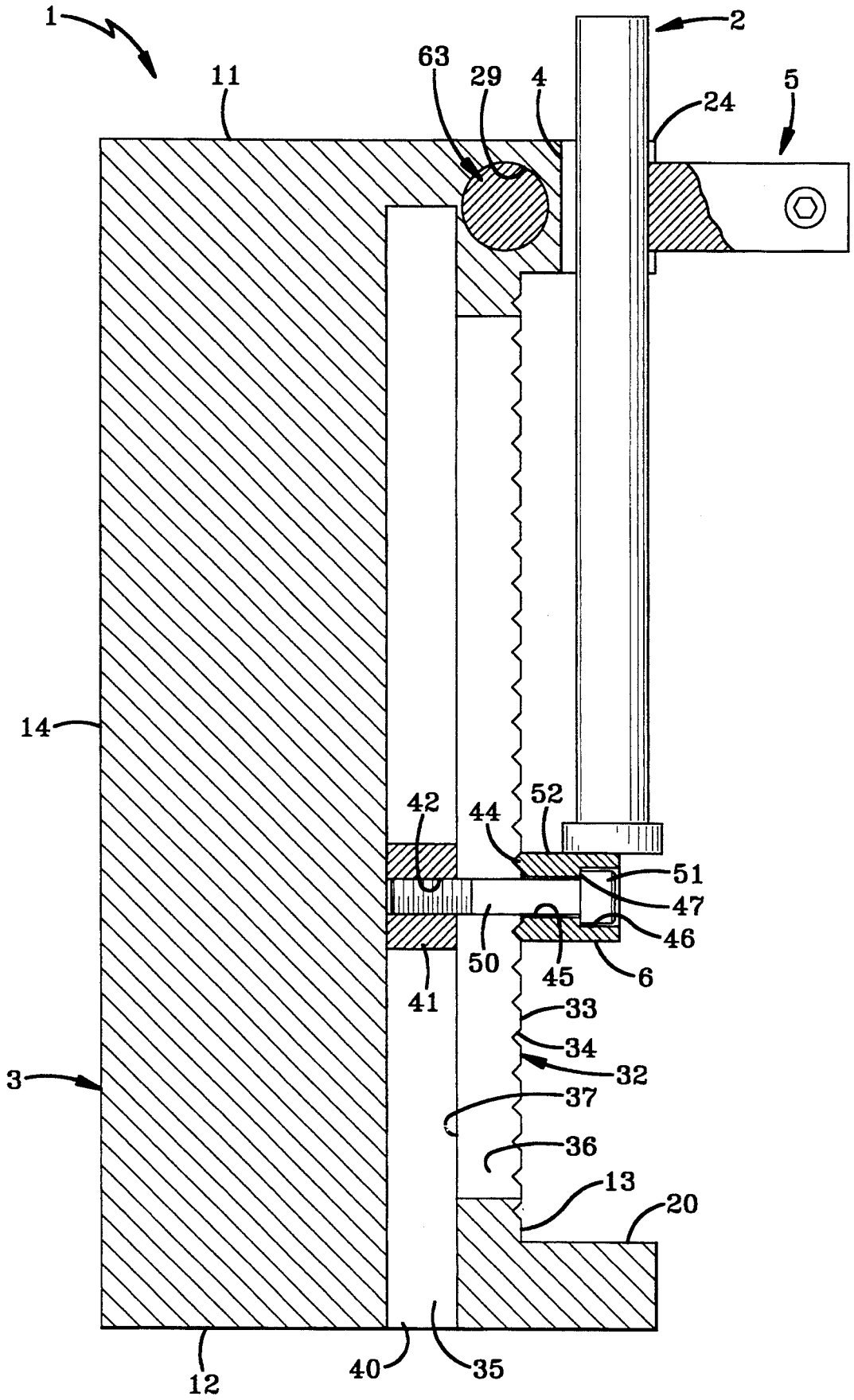
FIG. 3 is a side elevational view with a portion broken away and in section taken substantially along line 3—3 of FIG. 1.

A lock block 41 is slidably mounted within run 35 and is formed with a threaded hole 42 which extends through the center thereof. Threaded hole 42 has one end facing slot 36 such that as lock block 41 is moved within run 35, hole 42 remains positioned adjacent slot 36. In accordance with the invention, stop block 6 is positioned on rack 32, and includes two ratchet teeth 44 extending therefrom (FIG. 3). Ratchet teeth 44 are complementarily sized with recesses 34 and are spaced apart a distance which will allow them to fit within successive recess 34. Stop block 6 also includes a smooth aperture 45 of a first diameter, and a second smooth aperture 46 of a second larger diameter. First and second apertures 45 and 46 meet at shoulder 47. A threaded fastener 50 passes through apertures 45 and 46 and slot 36, and engages threaded hole 42 of block 41. Threaded fastener 50 includes a head 51 which is complementarily sized to fit within second aperture 46 and thus abuts shoulder 47. Threaded fastener 50 if of a sufficient length to permit free movement of stop block 6 on rack 32 when fastener 50 is loosely engaging lock block 41. In the preferred embodiment stop block 6 is rectangular but may have a variety of shapes and sizes without departing from the spirit of the present invention. Moreover, stop block 6 includes a bearing surface 52 to support workpiece 2.

Figure 5:
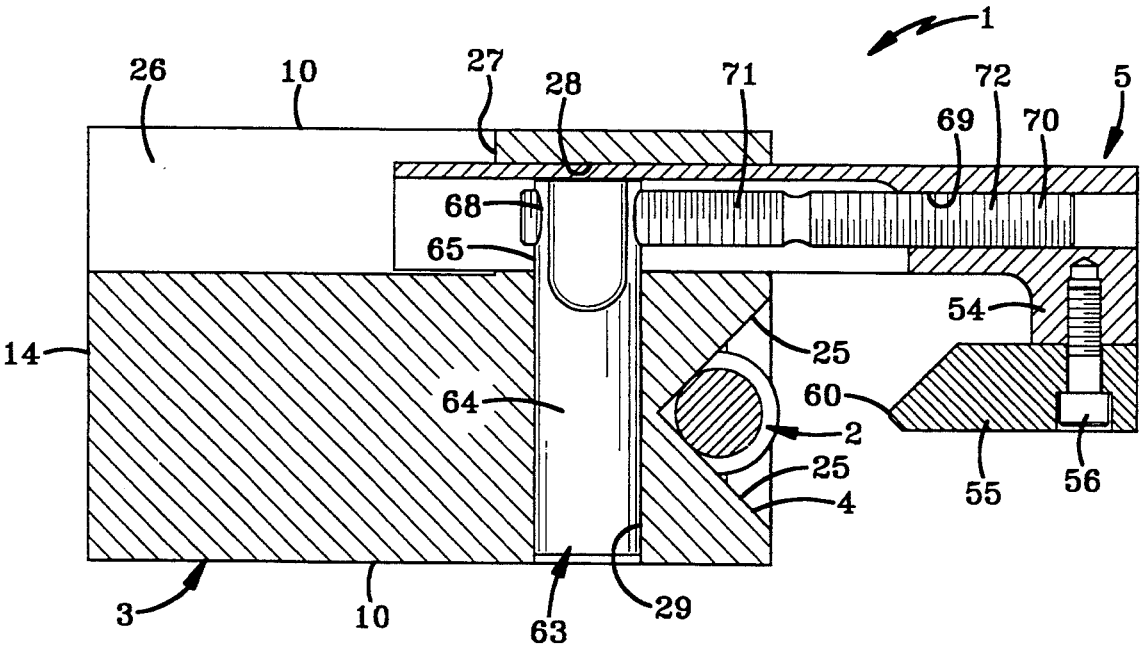
FIG. 5 is an end sectional view of the machine vise of FIG. 1 similar to that shown in FIG. 4, with the jaw shown in the open position.

Jaw bar 5 includes a guide channel 53 and a moveable jaw 54 (FIGS. 1 and 2). A removable grip plate 55 is attached to moveable jaw 54 via an allen screw 56 (FIG. 5). Grip plate 55 and moveable jaw 54 are positioned relative to each other via a key 57 and a keyway 58 (FIG. 1). Removable grip plate 55 is formed with a pointed contact edge 60. Guide channel 53 is complementary to and slidably mounted within hole 28 and is of sufficient length that it extends rearwardly beyond recessed wall 27. A rear portion 61 (FIGS. 2 and 4) of guide channel 53 is substantially square and is formed with a C-shaped opening 66 which extends partially throughout the length of channel 53. A hole 69 is formed in and extends through a front portion of guide channel 53 and communicates with C-shaped opening 66. Hole 69 is threaded in the counter clockwise direction.

As best seen in FIGS. 4 and 6, and in accordance with one of the main features of the invention, a replaceable plug indicated generally at 63 is mounted in aperture 29. Plug 63 includes a mounting section 64 which is complementarily sized to aperture 29. Plug 63 also includes an anchor section 65 which extends out of aperture 29 and into hole 28 and C-shaped opening 66 in a cantilever arrangement with respect to aperture 29. Anchor section 65 is narrower than mounting section 64 and is complementarily sized to fit within opening 66. The exterior surface of anchor section 65 thus slidably engages the interior surface of opening 66 while guide channel 53 moves within recess 26 to guide jaw bar 5 through recess 26. Anchor section 65 has an aperture 68 through the center thereof which is threaded in a clockwise direction.

A bolt 70 (FIG. 5) has a counter-clockwise, or right-hand threaded portion 71 for threadably engaging aperture 68 of plug 623, and a clockwise, or left-hand threaded portion 72 which threadably engages hole 69 of guide channel 53. In this manner, when bolt 70 is rotated a single revolution, the threadable engagement will axially index the bolt two pitch lengths. In this manner a single rotation of bolt 70 will axially translate the bolt two times as fast as if only a single threaded engagement were provided. The threaded engagement of bolt 70 and aperture 68 of plug 63 retains plug 63 within aperture 29 such that plug 63 loosely fits within aperture 29.

Turning to the operation of machine vise 1 (FIGS. 1, 4 and 5), threaded fastener 50 is loosened for example by an allen wrench to allow ratchet teeth 44 to be removed from engagement with rack 32. Once fastener 50 is sufficiently loosened, stop block 6 may be moved to the appropriate position on rack 32, and fastener 50 may be retightened to engage ratchet teeth 44 and rack teeth 33. As fastener 50 is tightened, lock block 41 will be drawn against shoulders 37 and ratchet teeth 44 will be drawn into corresponding recesses 34. In this manner the height of the workpiece 2 may be accurately set within vice 1. It is understood that while stop block 6 is moved along rack 32, lock block 41 is simultaneously being moved within run 35.

Once stop block 6 is positioned in the selected location on rack 32, and workpiece 2 is positioned on bearing surface 52, bolt 70 is rotated to cause threaded portions 71 and 72 to advance along aperture 68 and hole 69 respectively, thus causing pointed end 60 of grip plate 55 to contact workpiece 2 by moving from the position shown in FIG. 5 to the position shown in FIG. 4. Workpiece 2 is thus interposed between stationary jaw 4 and pointed end 60 such that cylindrical workpiece 2 is held within vice 1 via a three point contact.

Machine vise 1 may then be clamped adjacent the cutting tool by placing clamp jaws in any of the appropriate clamping recesses 15 or 16. In this manner the workpiece is accurately positioned adjacent the cutting tool, and multiple workpieces may be cut to within very close tolerances without time consuming set-up.

In accordance with the invention, plug 63 is easily replaceable by removing it from aperture 29 and inserting a new one therein. Plug 63 is a high stress and high wear part, due to the continuing threadable engagement between bolt 70 and aperture 68 of plug 63. This continued engagement, will often cause the threads to wear and loosen, or alternatively will cause plug 63 to fracture. By manufacturing machine vise 1 such that plug 63 is replaceable, the life span of vise 1 is significantly increased. As should be apparent to one of ordinary skill in the art, grip plate 55 may be easily replaced with a variety of configurations, or with a similar configuration if the original grip plate is damaged or worn.

As such, the machine vise of the present invention will accurately position an elongated bar-shaped workpiece adjacent a cutting tool such that the workpiece may be both end milled and milled along its longitudinal axis. Further, machine vise 1 provides a stop block which may be used to set the workpiece length, and which may remain set while subsequent workpieces are milled to length. Jaw bar 5 of the present invention, as well as stop block 6 may also be quickly adjusted to retain workpieces of a variety of lengths and diameters.

Accordingly, the improved machine vise is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved machine vise is constructed and used, the characteristics of the construction, and the advantageous, new and useful results obtained; the new and useful structures, devices, elements, arrangements, parts and combinations, are set forth in the appended claims.

I claim:

1. A machine vise adapted for securing a workpiece adjacent a cutting tool comprising:

a body having an aperture;

a stationary jaw formed on said body;

a moveable jaw bar slidably received within said aperture;

adjustment means for moving the jaw bar within said aperture between clamped and unclamped positions;

block means separate from said movable jaw and said stationary jaw for supporting an end of a workpiece in a selected position between said stationary jaw and said moveable jaw;

positioning means for positioning the block means longitudinally on said body in said selected position; and lock means for securing the block means in a selected position.

2. The machine vise as defined in claim 1 in which the positioning means includes at least one ratchet tooth extending outwardly from the block means, and a rack extending along said body formed with a plurality of recesses for selectively accepting said ratchet tooth to secure the block means in a selected position.

3. The machine vise as defined in claim 2 in which the recesses are equally spaced, and are complementary to said ratchet tooth.

4. A machine vise as defined in claim 1 in which said lock means includes a slide extending longitudinally along said rack, a lock block slidably mounted in said slide, and fastener means extending through said stop means and into said lock block for securing said ratchet tooth within a selected recess.

5. A machine vise as defined in claim 4 in which a slot is formed in the rack and extends longitudinally along said rack parallel to and in communication with the slide; in which a pair of shoulders is formed in said body on opposite sides of said slot; and in which the lock block is complementarily sized to said slide such that tightening of the fastener means will draw the ratchet tooth into one of said recesses, and will draw said lock block against said shoulders to tighten the stop means in a selected position.

6. A machine vise as defined in claim 4 in which the fastener means is a threaded bolt.

7. A machine vise as defined in claim 1 in which the jaw bar includes a guide channel slideably mounted in said aperture, and a movable jaw.

8. A machine vise as defined in claim 7 in which the movable jaw includes a removable grip plate.

9. A machine vise as defined in claim 1 wherein the stationary jaw is formed integrally with the body.

10. A machine vise as defined in claim 1 in which the stationary jaw is V-shaped; and in which the movable jaw is complementarily angled to a leg of the V-shaped stationary jaw.

11. A machine vise as defined in claim 2 in which there are between 8 and 14 recesses per inch formed in the rack.

12. A machine vise as defined in claim 1 in which the body is formed with a plurality of recesses adapted to receive a plurality of clamps to secure the vise adjacent a cutting tool.

13. A machine vise adapted for securing a workpiece adjacent a cutting tool comprising:

a body having an aperture;

a stationary jaw formed on said body;

a moveable jaw bar slidably received within said aperture;

adjustment means for moving the jaw bar within said aperture between clamped and unclamped positions;

block means for supporting an end of a workpiece in a selected position;

positioning means for positioning the block means in said selected position;

a plug extending into the body aperture;

a through hole formed in the jaw bar; and adjustment means located within said hole and engaging said plug for adjusting the moveable jaw with respect to the stationary jaw.

14. A machine vise as defined in claim 13 in which a threaded aperture is formed in the plug; and in which the adjustment means includes a bolt which threadably engages said threaded aperture.

15. A machine vise as defined in claim 14 in which the threaded aperture of the plug is threaded in a first direction; in which the through hole formed in the jaw bar is threaded in a second direction opposite the first direction; and in which a first half of the adjustment means bolt is threaded to operatively engage the threads in the plug, and a second half of the bolt is threaded to operatively engage the threads in said jaw bar hole.

16. A machine vise as defined in claim 14 in which the jaw bar includes a guide channel slidably mounted in said aperture; and in which the plug extends through an open side of the guide channel.

17. A machine vise as defined in claim 13 in which a hole is formed in the body and extends normal to the body aperture; and in which the bolt which threadably engages the threaded aperture of the plug retains the plug within said hole.

* * * * *